United States Patent [19]

Loquenz et al.

[11] Patent Number: 4,880,313

[45] Date of Patent: Nov. 14, 1989

[54] METHOD AND NOZZLE FOR MIXING MEDIUMS OF DIFFERENT VISCOSITY

[75] Inventors: Heinz Loquenz, Graz; Siegfried Meissl, Stallhofen, both of Austria

[73] Assignee: Waagner-Biro Aktiengesellschaft, Austria

[21] Appl. No.: 124,889

[22] Filed: Nov. 24, 1987

[30] Foreign Application Priority Data

Nov. 26, 1986 [AT] Austria ..... A 3156/86

[51] Int. Cl.[4] ..... S14E 44/10

[52] U.S. Cl. ..... 366/336; 137/606; 366/163; 366/173; 366/150; 366/165

[58] Field of Search ..... 366/336, 150, 163, 165, 366/167, 173, 176, 341; 137/4, 599, 606

[56] References Cited

U.S. PATENT DOCUMENTS

| | | | |
|---|---|---|---|
| 2,125,274 | 8/1938 | Gilbert | 366/165 |
| 2,528,094 | 10/1950 | Walker | 366/165 |
| 4,123,800 | 10/1978 | Mazzei | 366/150 |
| 4,215,081 | 7/1980 | Brooks | 366/163 |
| 4,478,516 | 10/1984 | Kessler | 366/340 |
| 4,647,212 | 3/1987 | Hankison | 366/165 |

FOREIGN PATENT DOCUMENTS

| | | | |
|---|---|---|---|
| 693841 | 9/1964 | Canada | 366/176 |
| 1179913 | 10/1964 | Fed. Rep. of Germany | 366/165 |
| 1212533 | 2/1986 | U.S.S.R. | 366/15 C |

*Primary Examiner*—Harvey C. Hornsby
*Assistant Examiner*—K. O'Leary
*Attorney, Agent, or Firm*—Steinberg & Raskin

[57] ABSTRACT

A multi-stage, especially a two-stage mixing of two media of different viscosity, and a respective mixing nozzle provided therefor. The first medium of higher viscosity is divided into two or more partial streams. The first partial stream is passed through an injector, in which the second medium of lower viscosity is mixed in, in particular tangentially. In an adjoining mixing chamber, the second partial stream of the first medium is admixed into the flowing mixture of the first partial stream and the second medium of lower viscosity and envelops the same, preferably in an opposite or counter-twist to the flowing twist of the first mixture of the first partial stream and second medium. This is especially suitable for bleaching of cellulose with oxygen.

16 Claims, 1 Drawing Sheet

METHOD AND NOZZLE FOR MIXING MEDIUMS OF DIFFERENT VISCOSITY

BACKGROUND OF THE INVENTION

The present invention relates to a method for mixing media having different viscosities, in particular gases with liquids, preferably in the bleaching of a cellulose suspension with oxygen, the velocity of the individual components being changed. The present invention also relates to a mixing device or nozzle for carrying out this method.

The mixing of media of different viscosities is known, where, however, the formation of streaks causes difficulties. The present invention specifically combats such streaking.

SUMMARY OF THE INVENTION

Accordingly, it is an object of the present invention to enhance mixing of media having different viscosities.

It is also an object of the present invention to enhance mixing of gases with liquids.

It is another object of the present invention to enhance bleaching of a cellulose suspension with oxygen.

It is an additional object of the present invention to eliminate or minimize formation of streaking in mixed media having different viscosities It is a further object of the present invention to admix media having different viscosities, without formation of bubbles or low viscosity streaks.

These and other objects are attained by the present invention which is directed to a method of mixing media of two different viscosities, which comprises splitting the medium having a higher viscosity into at least two partial streams, with a first one of these partial streams being passed into an injector having an inlet region and an outlet region. The first partial stream is introduced into the injector at the inlet region thereof. A stream of the medium of lower viscosity is passed into the injector in the region of the inlet thereof, whereby the first partial stream of higher viscosity mixes with the medium of lower viscosity, as the stream flows toward the outlet region thereof.

At least one of the remaining partial streams of higher viscosity is introduced into the flow at the outlet region, whereby the introduced partial stream is mixed with the flow of higher and lower viscosity streams, to form a combined stream. The flow of the combined stream is decelerated, whereby the low viscosity stream becomes intimately admixed with the high viscosity stream, without formation of bubbles or low viscosity streaks.

More particularly, the mixed flow of the first higher viscosity partial stream and the lower viscosity stream is directed along a mixing path, from the injector, and into a mixing chamber, with the remaining partial stream of higher viscosity being introduced into the mixing chamber itself. Preferably, the stream of lower viscosity is suctioned into the narrowest part of the injector, by flow of the first partial stream of higher viscosity into the injector. The remaining partial stream covers, i.e. preferably envelops, the mixed flow of the first partial stream and the stream of lower viscosity, in the mixing chamber itself.

The present invention is also directed to device for mixing media having at least two different viscosities, which comprises at least one injector having an inlet region and an outlet region, for receiving a partial stream of the medium of higher viscosity, and for receiving the medium of lower viscosity. A mixing chamber is provided downstream of the outlet region of the injector, for receiving a second partial stream of the medium of higher viscosity. Preferably, a mixing path communicates with the outlet region of the injector and opens into the mixing chamber.

The injector preferably comprises opening means at a suction side thereof, for the medium of lower viscosity, which are preferably situated at a narrowest part of the injector. The mixing chamber may comprise opening means for introducing the second partial stream thereinto, preferably in an eccentric or twisted manner.

Accordingly, the method of the present invention is characterized by the medium of higher viscosity being split into two partial streams, the first of which is guided (in particular, after a further splitting thereof into further divided-out streams) through an injector with a succeeding mixing path. The medium of lower viscosity is suctioned into the injector and brought into contact with the first partial stream, in the region of the narrowest point of the injector. In other words, the medium of lower viscosity is suctioned in by the flow energy of the first partial stream, in the region of the narrowest point of the injector.

In a mixing chamber at the end of the mixing path, the resulting first mixture (i.e. mixture of lower viscosity medium with the first partial stream of higher viscosity medium) is overlaid, in particular enveloped, by the second partial stream of higher viscosity, with this second resulting mixture being decelerated.

The mixing nozzle or device according to the present invention for carrying out this method, is characterized by one or more injectors connected in parallel being provided in a first partial stream of a medium of higher viscosity, with the medium of lower viscosity being connected or introduced thereinto on a suction side of each injector. Furthermore, each injector comprises, on an outflow side thereof, a mixing path leading into a mixing chamber, into which the second partial stream of the medium of higher viscosity is connected or introduced, in particular eccentrically.

BRIEF DESCRIPTION OF THE DRAWINGS

The present invention will be described in greater with reference to exemplary embodiments thereof illustrated in the accompanying figures, in which.

DESCRIPTION OF THE PREFERRED EMBODIMENTS

Figure 1:
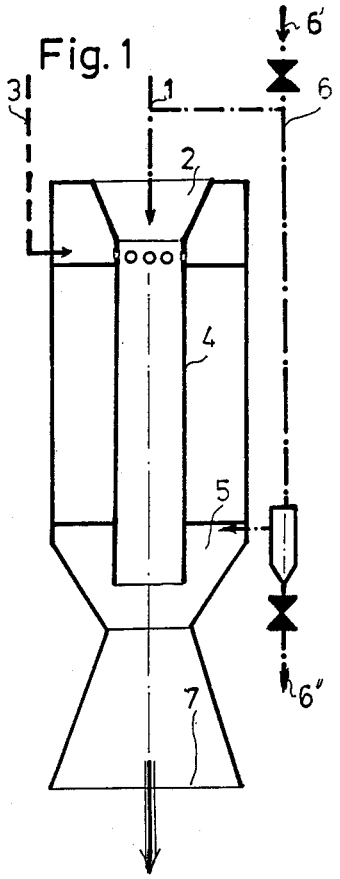
FIG. 1 is a schematic illustration of a mixing nozzle or device in simplest construction, in accordance with the present invention.
Figure 2:
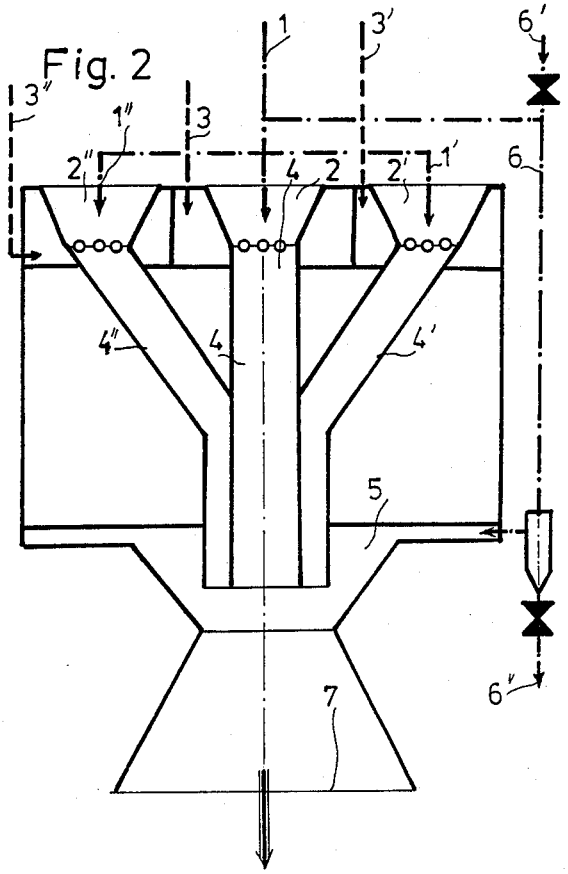
FIG. 2 is a schematic illustration of a mixing nozzle or device in accordance with the present invention, with several mixing channels leading into a common mixing line.
Figure 3:
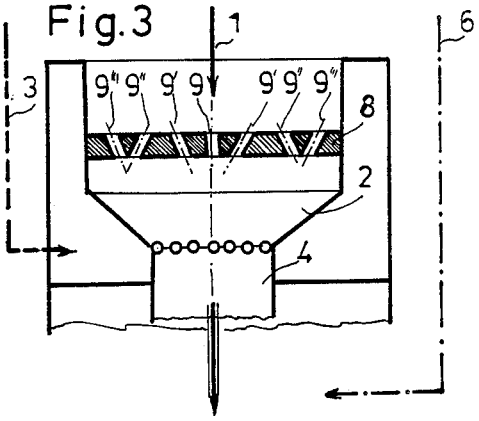
FIG. 3 is a schematic illustration of a mixing nozzle provided with a perforated plate in accordance with the present invention herein.

As noted above, FIG. 1 illustrates a mixing nozzle or device in simplest construction, in accordance with the present invention, while FIG. 2 illustrates a mixing nozzle or device of the present invention having several mixing channels which lead into a common mixing line or chamber, and FIG. 3 illustrates a mixing nozzle or device additionally having a perforated plate. Before entering into the mixing nozzle, the more viscous component to be mixed, e.g. a cellulose suspension to be bleached, is split into two partial streams 1 and 6. Stream 1 is introduced into an injector 2 of the mixing nozzle, and in doing so, suctions in a medium 3 of low viscosity to be added at the narrowest point of the injector 2. The medium 3 of lower viscosity is thereby mixed into the partial stream 1.

The resulting mixture is then guided at a constant speed along a mixing path 4 which leads into a mixing chamber 5 in which, similarly as with injector 2, the partial stream 6 is admixed instead of the medium 3. The introduction of the partial stream 6 is eccentric or helical, so that the partial stream 6 covers or envelops the partial stream 1, with both streams being guided through the mixing chamber 5 into a diffuser 7, connected thereto as illustrated. More specifically, the diffuser 7 is connected on an outflow side of the mixing chamber 5, and enlarges in cross-section away from the mixing chamber 5 as seen in FIG. 1.

Deceleration in the diffuser 7 causes a complete binding-in of the medium 3 of low viscosity, so that marginal bubbles or marginal stretches or streaks of low viscosity are avoided. In order to regulate the method, water may be admixed via line 6', or water may be removed via line 6'', whereby the viscosity of the partial stream 6 of higher viscosity to be admixed, can be altered as desired.

A similar construction is illustrated schematically in FIG. 2, in which the partial stream 1 is additionally divided, before entering into the mixing apparatus or nozzle, into three partial streams,1, 1', 1'', which are each first mixed with the medium 3 of low viscosity, similarly as in FIG. 1. The thus-mixed streams are then appropriately passed along connected mixing paths 4, 4', 4'', which are intertwined so that the issuing mixed medium stream has a twist. More particularly, the axes of the mixing paths 4, 4', 4'' lie on an hyperbloid of rotation, whereby a twisted flow is produced when the mixing paths are joined, e.g. in the mixing chamber 5 as seen in FIG. 2. Furthermore, the mixing paths 4', 4'' of the respective injectors 2', 2'' which are connected in parallel, have, relative to mixing path 4, a twist in one direction. The second partial stream 6 is then introduced into the mixing chamber 5, with an opposite or counter-twist enveloping the mixture of the first partial streams, 1, 1', 1''.

In the mixing chamber 5, the second partial stream is then admixed, but with the provision that the partial stream 6 which envelops the partial stream 1 has an opposite or counter-twist, so that the two partial steams 1 and 6 are whirled up together practically in the contact zone of the boundary layers thereof. For this purpose, the streams of low viscosity 3, 3', 3'' may have, for example, different chemical compositions as, e.g., ozone, oxygen, or peroxide, so that the complex region of cellulose bleaching can be simplified.

The present invention is not limited to the bleaching of cellulose, and can be used in any gas-liquid mixing apparatus, as e.g., also for waste water, in particular, in biological clarification plants. Since the liquid circulation systems have practically no inserts of any kind, the danger of clogging can be practically eliminated.

A sectional view of a mixing nozzle for large throughput or having a large diameter with an obliquely approached perforated plate 8, is shown in FIG. 3. Around a central hole 9 of this nozzle, concentric perforation rows having oblique holes 9, 9'', 9''' are arranged, in which the slope in the radial direction alternates outwardly and inwardly as illustrated. This construction is especially suitable for relatively clean liquids without major solid substances entrained therein. With this nozzle 8, a mesh of jets is produced which have a large surface area, so that intimate mixing with the second medium 3 of lesser viscosity and hence the solubility limit, is reached faster than with conventional mixers. The mixing chamber 5 (not illustrated) follows the illustrating mixing nozzle, similarly as in FIG. 1.

In the present invention, it is naturally possible to provide additional mixing chambers at he diffuser 7, with additional feeding of partial streams 6 of medium 1, thereby enveloping the jet passing from the mixing chamber 5 in several layers, with the additional possibility of the partial streams 6 being formed by a third medium. The medium of lower viscosity 3 is mixed in through the injector 2, especially tangentially.

The preceding description of the present invention is merely exemplary, and is not intended to limit the scope thereof in any way.

What is claimed is:

1. Method of mixing media of two different viscosities, which comprises splitting a liquid medium which is a cellulose suspension into at least two liquid partial streams, passing a first one of said liquid partial streams into an injector having an inlet region and an outlet region, at the inlet region of the injector, passing a stream of gaseous medium into the injector in the region of the inlet, whereby said first liquid partial stream mixes with said gaseous medium as the first liquid partial stream flows toward the outlet region, introducing at least one remaining liquid partial stream into the flow at the outlet region, whereby the introduced liquid partial stream is mixed with said flow of first liquid partial and gaseous streams to form a combined stream, and decelerating the flow of the combined stream, whereby the gaseous stream becomes intimately admixed with the liquid stream without formation of bubbles or low viscosity streaks, and cellulose contained in the cellulose suspension is effectively bleached by the gaseous medium.

2. The method of claim 1, additionally comprising directing the mixed flow of the first liquid partial stream and the gaseous stream along a mixing conduit from the injector and into a mixing chamber, whereby said remaining liquid partial stream is introduced into the mixing chamber.

3. The method of claim 2, wherein the gaseous stream is suctioned into a narrowest part of the injector by flow of the first liquid partial stream into the injector.

4. The method of claim 3, wherein the remaining liquid partial stream covers the mixed flow of the first liquid partial stream and the gaseous stream in the mixing chamber.

5. The method of claim 4, wherein the second or remaining liquid partial stream envelops the mixed flow in the mixing chamber.

6. The method of claim 2, comprising the additional step of dividing said first liquid partial stream into several streams which are each then directed into a respective injector and then directed along a respective mixing conduit to the mixing chamber, with the gaseous medium contacting at least one of the divided out liquid streams in at least one of the respective injectors.

7. The method of claim 6, comprising the additional step of creating a twisted flow of a combined stream of the divided out liquid streams in the mixing chamber by directing the respective divided out liquid streams along the respective mixing conduits having axis lying along an hyperboloid of rotation with respect to one another.

8. The method of claim 6, comprising the additional step of directing different media of lower viscosity into each of the divided out liquid streams of the first liquid partial stream in the respective injectors.

9. The method of claim 2, comprising the additional step of altering viscosity of the remaining liquid partial stream by admixing liquid therein or by removing liquid therefrom, before directing the same into the mixing chamber.

10. The method of claim 9, wherein the liquid is water.

11. The method of claim 2, comprising the additional step of dividing said first liquid partial stream into two streams which are each then directed into a respective injector and contacted by the gaseous medium and then directed along a respective mixing conduit to the mixing chamber.

12. The method of claim 11, comprising the additional step of creating a twisted flow of combined streams of the first liquid partial stream and the gaseous stream in the mixing chamber.

13. The method of claim 12, wherein the twisted flow is generated by directing the respective combined streams of gaseous medium and one of two streams subdivided from the first liquid partial steam, along the respective mixing conduits having axes lying along an hyperboloid of rotation with respect to one another.

14. The method of claim 12, wherein the twisted flow is produced by intertwining the respective mixing conduits.

15. The method of claim 9, wherein the remaining liquid partial stream is directed into the mixing chamber in counter-twist to the twist flow.

16. The method of claim 3, comprising the additional step of directing the first liquid partial stream through a perforated plate having a central passage and obliquely-sloping holes thereabout, whereby several jets of the first liquid partial stream are generated in the injector and intimate mixing with the gaseous medium is enhanced.

* * * * *